US008786458B1

(12) United States Patent
Wiltzius et al.

(10) Patent No.: US 8,786,458 B1
(45) Date of Patent: Jul. 22, 2014

(54) BROWSER-BASED ALERTING SYSTEM

(75) Inventors: Thomas Christian Wiltzius, Santa Barbara, CA (US); Kathryn Cushing, San Francisco, CA (US); Gregory Matthew Marra, San Francisco, CA (US); Gideon Wald, San Francisco, CA (US)

(73) Assignee: Google Inc., Mountain View, CA (US)

( * ) Notice: Subject to any disclaimer, the term of this patent is extended or adjusted under 35 U.S.C. 154(b) by 204 days.

(21) Appl. No.: 13/399,890

(22) Filed: Feb. 17, 2012

(51) Int. Cl.
*G08B 3/00* (2006.01)
*G08B 5/00* (2006.01)
*G08B 7/00* (2006.01)

(52) U.S. Cl.
USPC ..... 340/691.6; 709/203

(58) Field of Classification Search
USPC ..... 340/691.6; 455/404.1; 709/203, 206, 709/207; 725/33, 34, 35
See application file for complete search history.

(56) References Cited

U.S. PATENT DOCUMENTS 6,721,805 B1 * 4/2004 Bhagwat et al. ..... 709/250
6,778,834 B2 * 8/2004 Laitinen et al. ..... 709/229
7,752,259 B2 * 7/2010 Weiser et al. ..... 709/203
7,814,145 B2 * 10/2010 Lundy et al. ..... 709/203
8,026,806 B2 * 9/2011 Hasek et al. ..... 340/539.16
8,073,903 B2 * 12/2011 Wood et al. ..... 455/404.1
2009/0309742 A1 * 12/2009 Alexander et al. ..... 340/601
2012/0295570 A1 * 11/2012 Roin et al. ..... 455/404.1

OTHER PUBLICATIONS

Jewett, D., "Disaster Alerts—Brower & Mobile", *Random hacks of Kindness*, May 19, 2011, pp. 1-5, http://www/rhok.org/problems/dister-alerts-browser-mobile.
"Firefox browser CAP Alerting Plugin (Sahana idea for GSOC2009)" *Gav's Blog*, pp. 1-8, Mar. 4, 2009, http://www.rediguana.co.nz/gav/2009/03/04/firefox-browser-cap-alerting-plugin-sahana-id.
"Browser Alerts", *Browser Alerts Problem Definition*, last updated Jun. 7, 2010, accessed Feb. 17, 2012, p. 1, http://wiki.rhok.org/Browser_Alerts.

* cited by examiner

*Primary Examiner* — John A Tweel, Jr.
(74) *Attorney, Agent, or Firm* — Sterne, Kessler, Goldstein & Fox P.L.L.C.

(57) ABSTRACT

Disclosed herein are methods and systems for displaying alerts in a web browser. An alert repeater is configured to receive an alert from an alert provider. A geographical determiner is configured to determine an effective geographical area for the alert. The alert repeater sends the alert over a browser update communication channel to an alert receiver in a web browser within effective geographical area. The alert receiver then displays the alert in the web browser.

26 Claims, 5 Drawing Sheets

BROWSER-BASED ALERTING SYSTEM

BACKGROUND

1. Field

Embodiments relate to alerting systems.

2. Background

Alerts, and in particular, time-critical alerts, often are needed to be delivered to a user in a manner that garners the user's attention and communicates the critical information in the most efficient manner possible. However, many alert systems are not effective in providing information to a large number of people, because they are either outdated or require additional effort on the part of those people. For example, the Emergency Broadcasting System requires that a person have a radio or television on to receive the alert. Other alert systems, such as text messaging alerts, require a person to specifically sign up (and often pay for) the alert service.

BRIEF SUMMARY

Embodiments include methods and systems for displaying alerts in web browsers. In an embodiment, an alert is received over a communication channel from an alert provider, and sent to an alert receiver over a browser update communication channel, wherein the alert receiver has been installed in a web browser without any user interaction and the alert receiver is configured to display the alert in the web browser. A geographical determiner is configured to determine an effective geographical area for the alert, and limit the alert to the effective geographical area, wherein the alert is only sent to an alert receiver located in the effective geographical area.

Further embodiments, features, and advantages of the invention, as well as the structure and operation of the various embodiments of the invention are described in detail below with reference to accompanying drawings.

BRIEF DESCRIPTION OF THE DRAWINGS/FIGURES

Embodiments of the invention are described with reference to the accompanying drawings. In the drawings, like reference numbers may indicate identical or functionally similar elements. The drawing in which an element first appears is generally indicated by the left-most digit in the corresponding reference number.

DETAILED DESCRIPTION

While the present invention is described herein with reference to the illustrative embodiments for particular applications, it should be understood that the invention is not limited thereto. Those skilled in the art with access to the teachings provided herein will recognize additional modifications, applications, and embodiments within the scope thereof and additional fields in which the invention would be of significant utility.

In the detailed description of embodiments that follows, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Figure 1:
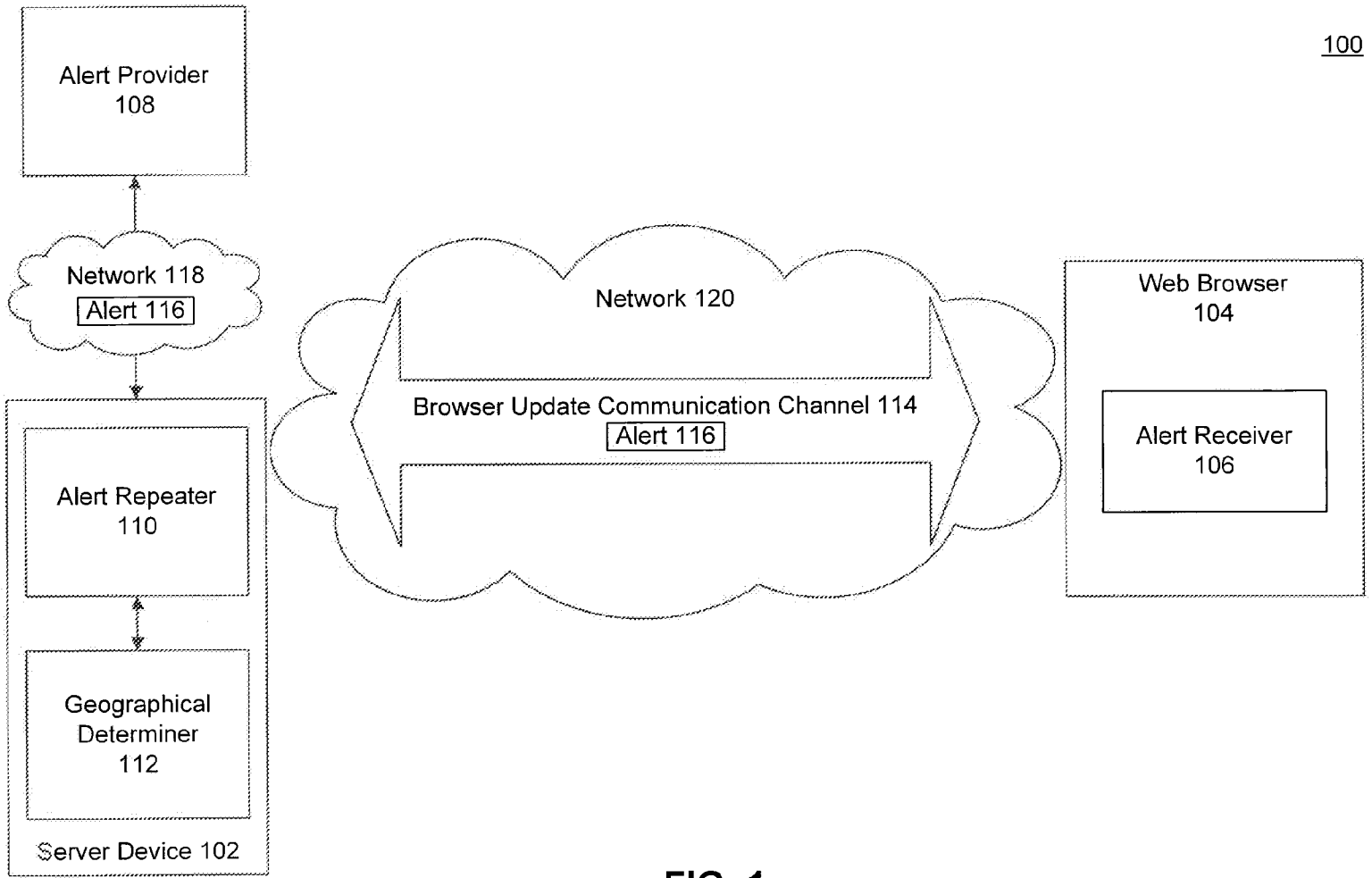
FIG. 1 is a block diagram of an alert system for a web browser, according to an embodiment.

FIG. 1 is a block diagram of an alert system 100 for operation in a web browser, according to an embodiment. System 100 includes a server device 102, a web browser 104, and an alert provider 108. Server device 102 may be any type of computing device and any number of computing devices that alone or in combination implement system 100. For example, server device 102 may be a single server, or a number of computing devices coupled together to form a cloud architecture for the hosting of applications. Server device 102 is primarily responsible for supplying software updates required for the operation of web browser 104. For example, from time to time a web browser manufacturer or developer may need to provide software updates to a web browser. The software updates may contain additional features and/or fixes for discovered software bugs or security vulnerabilities. A communications channel between server device 102 and web browser 104 is typically reserved for this purpose and is not accessible to third parties. Web browser 104 may be a standalone software application or a part of a software application that displays or uses a web application, website, or webpage. Web browser 104 may also run on any type of computing device, such as a personal computer or mobile phone.

Alert provider 108 may be configured to create and send alert 116 to server device 102. Alert 116 may relate to a time-sensitive event that has occurred or is about to occur. For example, alert 116 may relate to a natural disaster, national security event, or another important event. Alert 116 may originate from any type of organization and may be related to any type of information that may need to be displayed to a user as an alert. However, according to an embodiment, alert 116 originates from a governmental entity. In particular, alert provider 108 may be located within the organization responsible for alerting. For example, alert provider 108 may be located within the governmental entity. Alert provider 108 may then be configured to send alert 116 when the organization deems it appropriate, over a network 118 to server device 102. Network 118 may be a wide area network (WAN), a local area network (LAN), or a combination of both. Alert provider 108 may communicate using a known alerting protocol format, for example, common alerting protocol (CAP). However, alert provider 108 may communicate using other messaging formats as well, including XML.

Alert provider 108 may also be configured to retrieve alert information from an organization, such as a government agency, and create alert 116 based upon the retrieved information. In such a case, alert provider 108 may be located outside of the organization or even within server device 102. For example, alert provider 108 may be configured to subscribe to an organization's real simple syndication (RSS) feed or may be configured to scrape information from a website. Alert provider 108 may then use the information retrieved using RSS or scraping to form and send alert 116. However, alert provider 108 may also manually communicate alert 116 to server device 102. For example, alert provider 108 may be a person or automated means that notifies another who is in control of server device 102 to send out alert 116. This notification may occur, for example, via telephone, email, or other means.

Server device 102 also includes an alert repeater 110. Alert repeater 110 may be configured to receive alert 116 from alert provider 108 and send alert 116 over a browser update communication channel 114 to web browser 104. However, in some cases alert 116 may not be in a format which is compatible with browser update communication channel 114. In such cases, alert repeater 110 may convert alert 116 into a format that can be sent over browser update communication channel 114. In particular, when alert 116 is sent over browser update communication channel 114, alert 116 may include text that is displayed to the user. Additionally alert 116 may also include any combination of a web link for more information about the alert, information related to the severity of the alert, or an expiration time for the alert.

Browser update communication channel 114 is a dedicated communication channel that is responsible for sending browser software updates to web browser 104. In particular, browser update communication channel 114 may use a protocol that is responsible for managing the sending and receiving of updates to web browser 104. For example, browser update communication channel 114 may allow for messages, in the form of eXtensible Markup Language (XML), to be sent between web browser 104 and server device 102. Browser update communication channel 114 may also support sending binary data. For example, browser updates may include software binaries that update web browser 104. However, because browser update communication channel 114 communicates updates to web browser 104, browser update communication channel 114 is secure and robust. For example, because the software updates that browser update communication channel 114 may communicate to web browser 104 update the software code of web browser 114, access may be controlled to browser update communication channel 114. In particular, only trusted sources may use browser update communication channel 114. For example, the developer or manufacturer of web browser 104 may have access to browser update communication channel 114 in order to provide updates to web browser 104. As a result, malicious updates or messaging may be avoided, as only trusted sources are permitted to have access to send updates or messages over browser update communication channel 114. Additionally, browser update communication channel 114 may be encrypted. For example, browser update communication channel 114 may use secure socket link (SSL) for encryption. Browser update communication channel 114 may also be configured to provide corresponding hashes to messages and updates, such that web browser 104 may be able to authenticate the identity of service device 102 using public/private key encryption. Browser update communication channel 114 may also have a very robust and a strong infrastructure with high availability as browser update communication channel 114 may be responsible for communications with millions of web browsers across many different time zones.

Browser update communication channel 114 may run over a network 120. Network 120 may be a WAN, LAN, or a combination of both. Browser update communication channel 114 may be configured to use peer-to-peer or direct communications. Browser update communication channel 114 may also be configured to allow for alert 116 to be sent. For example, the communication protocol of browser update communication channel 114 may have the capability of sending alerts from trusted sources. In particular, browser update communication channel 114 may be able to communicate alerts having text that is displayed to the user. Additionally, browser update communication channel 114 may be able to communicate any combination of a web link for more information about the alert, information related to the severity of the alert, or an expiration time for the alert. However, as discussed above, alert 116 may need to be converted to be able to be communicated using the protocol of browser update communication channel 114.

Web browser 104 may receive alert 116 in alert receiver 106 and then display the contents of alert 116 in the web browser. For example, web browser 104 may display the text of alert 116 in a status bar. The color of the status bar displayed in web browser 104 may change based upon the severity level. For example, for very severe alerts the color of the status bar may be red. Additionally, the status bar may display a hyperlink from the web link in alert 116.

Because browser update channel 114 is a dedicated communication link between web browser 104 and server device 102, channel 114 does not have to be actively maintained or managed by a user. Alert receiver 106 may be enabled in web browser 104 by default. Accordingly, the user may not have to enter any information, perform an action, or install alert receiver 106 for alert receiver 106 to receive alert 116 in web browser 104. Alert receiver 106 may also be configured to run natively within web browser 104, instead of, for example as a plugin.

Web browser 104 may communicate with server device 102 over browser update communication channel 114 using a polling method of communication, according to an embodiment. In particular, alert receiver 106 may be configured to check server device 102 at regular intervals over browser update communication channel 114 for any available alerts. For example, alert receiver 106 may be configured to check server device 102 every five minutes to determine whether server device 102, and in particular alert repeater 110, has created alert 116. Accordingly, alert receiver 106 may send a message over browser update communication channel 114 that asks server device 102 whether there is an outstanding alert. If there is an alert, server device 102 may respond with the alert message, such as alert 116. Alternatively, server device 102 may respond with a message communicating an alert is available, and alert receiver 106 may then send a message asking for the alert. Then, server device 102 may respond by sending the alert, for example alert 116.

According to an embodiment, instead of web browser 104 itself polling server device 102, another service, external to web browser 104 and in communication with web browser 104, may poll server device 102. For example, the computing device on which web browser 104 runs may be configured to run another service or program that may be always running and that is responsible for polling server device 102. In such a case, if the service determines that alert 116 is available, the service may then communicate alert 116 to alert receiver 106, which in turn may cause the contents of alert 116 to display in web browser 104.

Server device 102 may also push alert 116 to web browser 104, according to an embodiment. In particular, alert receiver 106, upon the initialization of web browser 104, may establish a constant communication socket with server device 102 using browser update communication channel 114. Thus, server device 102 may be able to communicate alerts, such as alert 116, to alert receiver 106 over the communication socket in real-time. Alternatively, according to an embodiment, a service may instead be responsible for establishing the socket with server device 102. If alert 116 is pushed over browser update communication channel 114 through the socket, the service may in turn communicate alert 116 to alert receiver 106. However, the exact implementation of the messaging protocol that web browser 104, alert receiver 106, and server device 102 may use, over browser update communication channel 114, may depend on the specific protocol that browser update communication channel 114 implements, and may also depend on the capabilities and features of web browser 104. A person having skill in the art would be able to adapt the methods and systems disclosed herein to any type of browser update communication channel and any type of web browser.

Server device 102 also includes a geographical determiner 112. Geographical determiner 112 may be configured to limit alert 116 to its affected geographical area. For example, server device 102 may communicate with more than one web browser located in different geographical areas. In some cases, alert 116 may only be useful to a finite geographical area, such as in the case of some natural disasters or weather events. Accordingly, in some cases, alert 116 may also contain location information related to alert's 116 affected areas, such as one or more ZIP codes, states, countries, or other regional information. In such a case, geographical determiner 112 may be configured to limit the recipients of alert 116, such that alert 116 is only sent to web browsers located in the affected area. In particular, geographical determiner 112 may use IP geolocation to determine the approximate location of web browser 104. IP geolocation is a technique where a location is determined based upon a computer's IP address. For example, based upon the IP address that web browser 104 uses to communicate with server device 102, geographical determiner 112 may use IP geolocation to determine an approximate location of web browser 104. If the location is within the affected area, then alert 116 may be sent to web browser 104.

Web browser 104 may also be configured to send its location based upon data entered through the browser's configuration settings. Accordingly, geographical determiner 112 may be configured to use IP geolocation, manually-entered information, or both. For example, the browser may have configuration settings that permit the user to enter location information such as a ZIP code, a telephone area code, or other information that may help identify the location of web browser 104. The location information may then be transmitted to server device 102, and in particular geographical determiner 112, such that geographical determiner may be able to determine the location of web browser 104. In such a case, geographical determiner 112 may use IP geolocation by default, unless geographical determiner 112 receives more specific location information from web browser 104. If the location is within the affected area, then alert 116 may be sent to web browser 104.

In some cases, while a user is using other applications, web browser 104 may not be active on the user's computing device. For example, a window of web browser 104 may be minimized. In such cases, when alert receiver 106 receives an alert, alert receiver 104 may cause the window of web browser 104 to be restored such that the user may see the alert. In other cases, web browser 104 may not even be opened when an alert is available. However, according to an embodiment, another service, external to web browser 104, may be responsible for receiving alert 116. In such a case, the service may be configured to open web browser 104, if it is closed, and then display the contents of alert 116.

Figure 2:
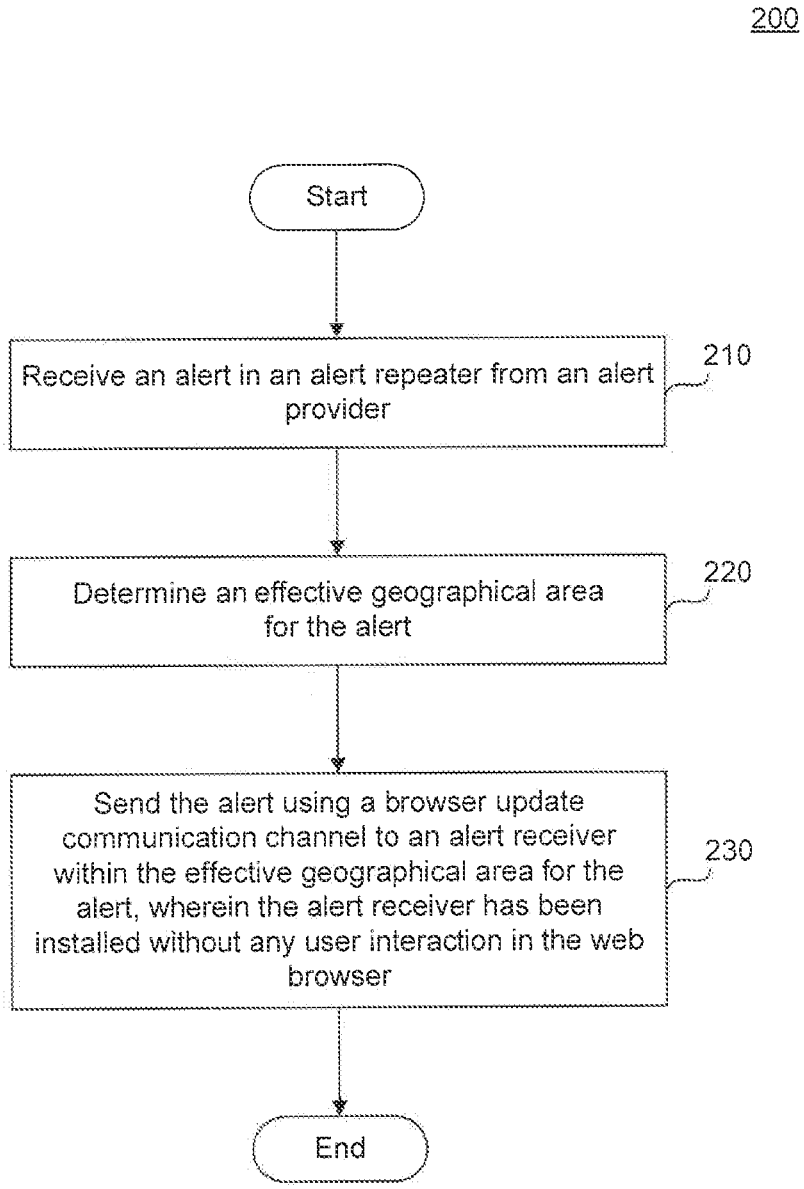
FIG. 2 is a flow diagram of a method of sending an alert to a web browser, according to an embodiment.

FIG. 2 is a flow diagram of a method 200 of sending an alert to a web browser, according to an embodiment. At block 210 of method 200, an alert is received in an alert repeater from an alert provider. For example, alert 116 may be received by alert repeater 110 from alert provider 108. The alert provider may be located within any organization. For example, the alert provider may be located within a government agency or within a private corporation. The alert provider may then send the alert automatically, or when the organization deems it appropriate, over a network using a known communication protocol. Alternatively, according to an embodiment, the alert provider may manually send the alert. For example, the alert may be manually sent by a phone call or an email. The alert provider also may be located outside of an organization. In particular, the alert provider may be configured to retrieve the alert from that organization and then relay the alert to the alert repeater. For example the alert provider may be configured to retrieve the alert from an organization using RSS or data scraping and then send the alert to the alert repeater.

At block 220, an effective geographical area is determined for the alert. In some cases, the alert may only be useful to a defined geographical area. In such cases, the alert may contain information specifying an affected area. For example, the alert may be related to a weather event or natural disaster confined to a certain geographical area. Accordingly, the alert may only be sent to web browsers within the effective geographical area. However, the location of the web browser to which the alert is going to be sent may first need to be determined. For example, a geographical determiner, such as geographical determiner 112, may determine a web browsers location based upon IP geolocation or from information the browser communicated, such as a ZIP code, area code, or other location information. If the web browsers location is determined to be within the affected area, then the alert repeater may send the alert to the web browser.

At block 230, the alert is sent using a browser update communication channel to an alert receiver within the effective geographical area for the alert, wherein the alert receiver has been installed without any user interaction in the web browser. For example, the alert receiver may be installed with the web browser during the installation of the web browser. This may permit the alert receiver to begin receiving alerts without the user performing any extra actions such as filling in information. The alert receiver may also be native to the browser, for example not installed as a plugin. Additionally, the alert receiver may receive the alert using a polling or a push method of communication.

The browser update communication channel may be a communication channel that is responsible for alerting a web browser that a browser software update is available and sending the update to the web browser. The browser update communication channel may run over a network such as a wide area network (WAN), a local area network (LAN), or a combination of both. The browser update communication channel may also be configured to incorporate messaging related to the alert. For example, the browser update communication channel may allow for an alert message to be sent using its communication protocol. The message may include text related to the alert that may be displayed in the browser and a web link for more information. The message additionally may include information related to the severity of the alert and an expiration time for the alert.

If an alert receiver is located within the effective geographical area of the alert, the alert may be sent over the browser update communication channel to that alert receiver. For example, alert 116 may be sent from alert repeater 110 to alert receiver 106. In some cases, the alert received from the alert provider in the alert receiver may be in a different format then what may be required over the browser update communication channel. The alert repeater may be configured to convert the alert into a format that may be sent using the browser update communication channel. For example, the browser update communication channel may not be able to support the CAP format, which is a common format for alerts. However, the alert repeater may receive an alert in CAP format. In such a case, the alert repeater may be configured to decode the alert in CAP format and convert the alert into a message that may be sent over the browser update communication channel.

Figure 3:
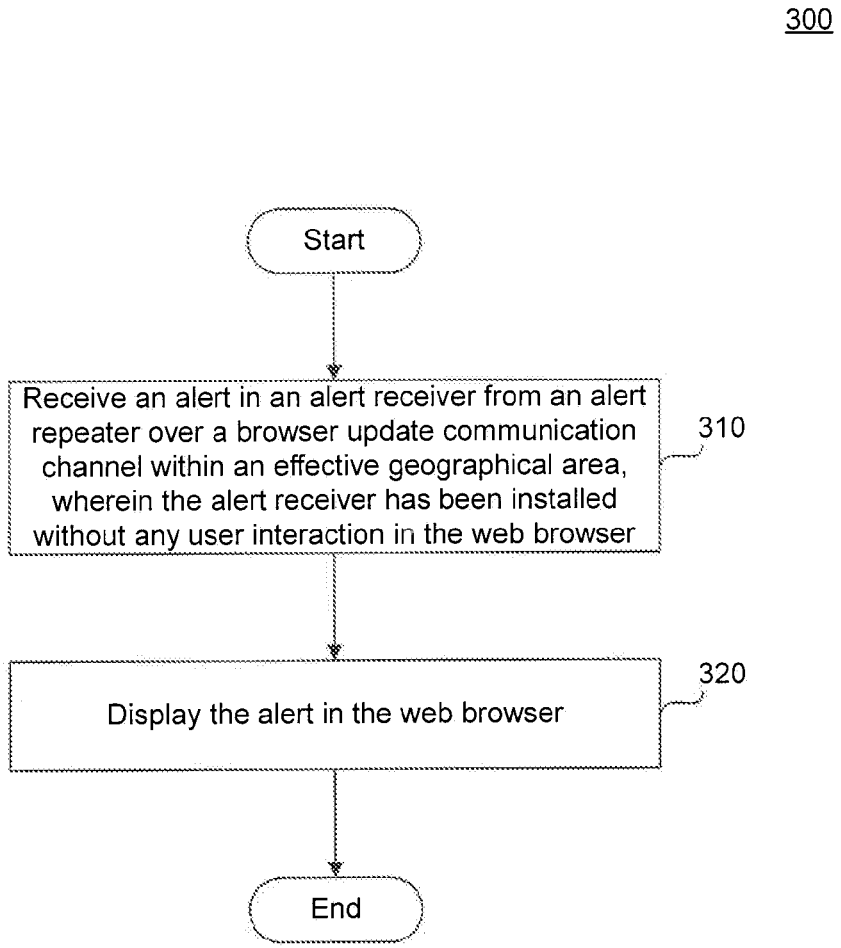
FIG. 3 is a flow diagram of a method of receiving an alert in a web browser, according to an embodiment.

FIG. 3 is a flow diagram of a method 300 of receiving an alert in a web browser, according to an embodiment. At block 310 of method 300, an alert is received in an alert receiver from an alert repeater over a browser update communication channel within an effective geographical area, wherein the alert receiver is installed in the web browser without any user interaction. For example, the alert receiver may be installed in the web browser during the installation of the web browser. This may permit the alert receiver to begin receiving an alert without the user performing any extra actions such as filling in information or selecting particular software to install, such as a plugin.

At block 320, the alert is displayed in the web browser. The alert may be displayed in a number of ways in the web browser. In an embodiment, the alert may be displayed as a status bar below the address bar in a web browser. If the web browser is minimized because, for example, a user is working in another application, the browser may automatically be restored, such that the user may see the alert. Furthermore, according to an embodiment, if the web browser is closed, the web browser may be automatically opened to display the alert. The alert may also change colors depending on the severity level of the alert. For example, in the case of a severe alert, the alert may appear red, while a less severe alert may appear yellow, or a different color. The alert may also contain a selectable link that may open up a webpage displaying further information regarding the alert to the user. For example, the link may reference information on a government website discussing specific details related to the alert or information relating to preparedness for the alert.

Figure 4:
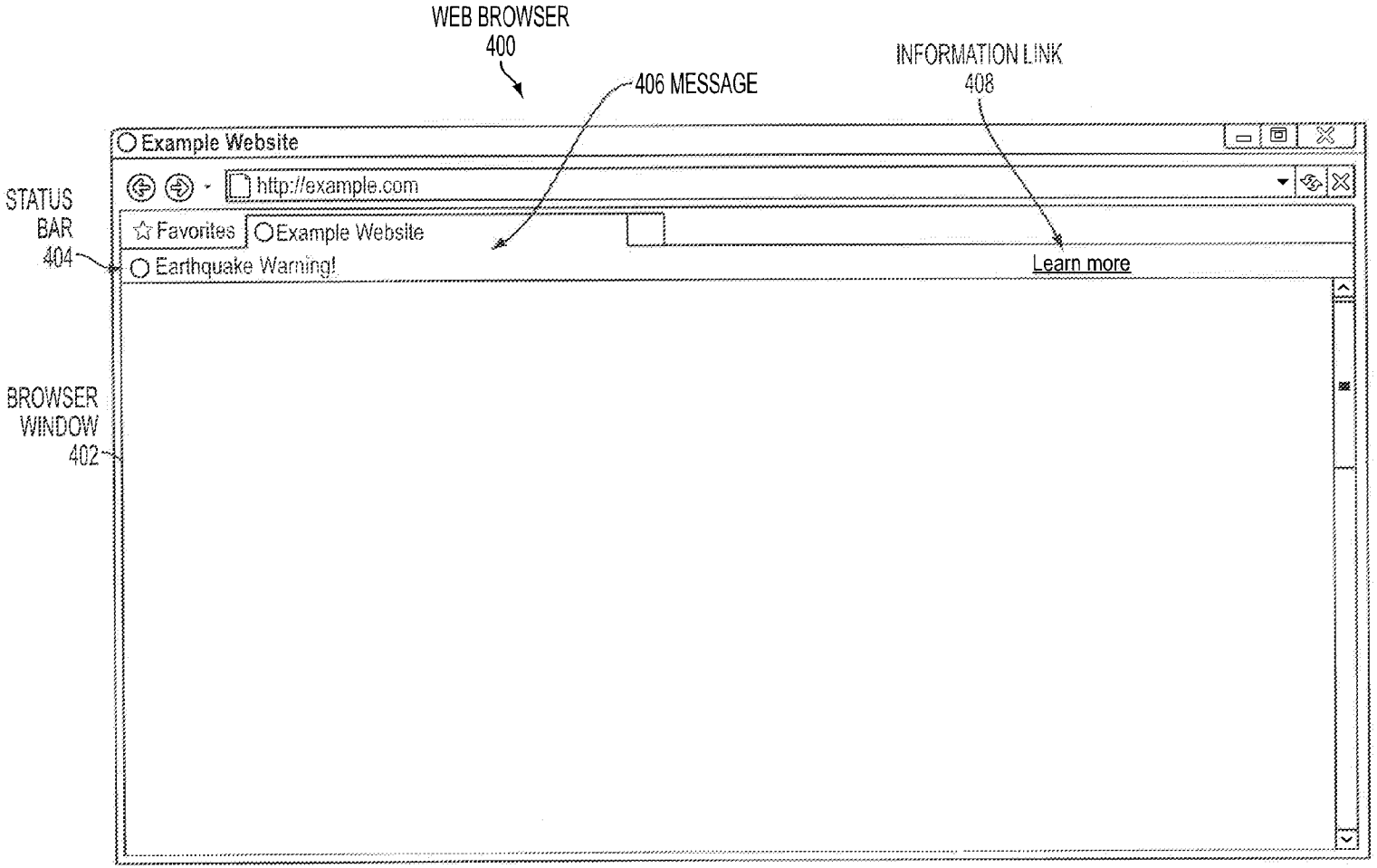
FIG. 4 is a diagram of an alert displayed in an example web browser, according to an embodiment.

FIG. 4 is a diagram of an alert displayed in an example web browser, according to an embodiment. Web browser 400 includes a browser window 402 and a status bar 404. Browser window 402 may be configured to display website content and other multimedia displayed during a normal browsing session. Status bar 404 may be configured to be hidden during normal browser operation. If an alert is received by web browser 400, web browser 400 may display status bar 404. Status bar 404 includes a message 406 and an information link 408. Message 406 may display the message received in the alert. For example, message 406 may display "Earthquake Warning!", when an alert relates to an earthquake that may have occurred or is impending. Message 406 may also include information link 408. Information link 408 may link to a webpage providing further information related to the alert. For example, in the case of an earthquake alert, the linked webpage may provide details related to the earthquake or provide earthquake preparedness or recovery information. According to an embodiment, instead of directing a user to a webpage, information link 408 may cause another window to appear when selected, such as a dropdown box or popup window displaying the further information. In some cases, status bar 404 may also change colors depending on the severity of the alert. For example, status bar 404 may appear as red for a severe alert, while another color, such as yellow may appear for a less severe alert.

Figure 5:
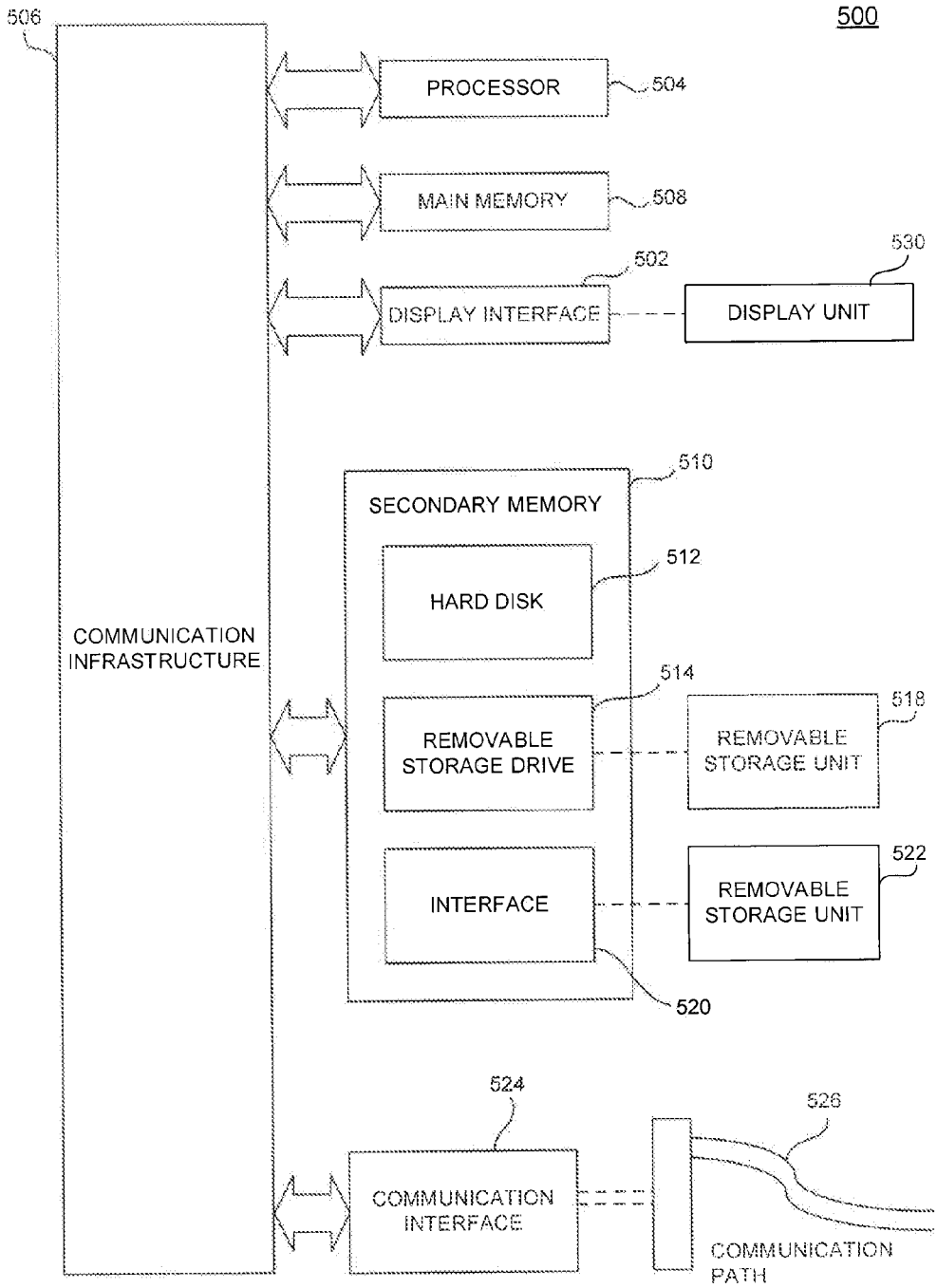
FIG. 5 illustrates an example computer system in which embodiments as described above, or portions thereof, may be implemented.

FIG. 5 illustrates an example computer system 500 in which embodiments as described above, or portions thereof, may be implemented. For example, server device 102, web browser 104, or alert provider 108, including portions thereof, may be implemented in computer system 500 using hardware, software, firmware, tangible computer readable media having instructions stored thereon, or a combination thereof and may be implemented in one or more computer systems or other processing systems. Hardware, software, or any combination of such may embody any of the modules, procedures, and components in FIGS. 1-4.

One of ordinary skill in the art may appreciate that embodiments of the disclosed subject matter can be practiced with various computer system configurations, including multi-core multiprocessor systems, minicomputers, mainframe computers, computers linked or clustered with distributed functions, as well as pervasive or miniature computers that may be embedded into virtually any device.

For instance, a computing device having at least one processor device and a memory may be used to implement the above-described embodiments. A processor device may be a single processor, a plurality of processors, or combinations thereof. Processor devices may have one or more processor "cores."

Various embodiments of the invention are described in terms of this example computer system 500. After reading this description, it will become apparent to a person skilled in the relevant art how to implement embodiments using other computer systems and/or computer architectures. Although operations may be described as a sequential process, some of the operations may in fact be perforated in parallel, concurrently, and/or in a distributed environment, and with program code stored locally or remotely for access by single or multi-processor machines. In addition, in some embodiments the order of operations may be rearranged without departing from the spirit of the disclosed subject matter.

As will be appreciated by persons skilled in the relevant art, processor device 504 may also be a single processor in a multi-core/multiprocessor system, such system operating alone, or in a cluster of computing devices operating in a cluster or server farm. Processor device 504 is connected to a communication infrastructure 506, for example, a bus, message queue, network, or multi-core message-passing scheme.

Computer system 500 also includes a main memory 508, for example, random access memory (RAM), and may also include a secondary memory 510. Secondary memory 510 may include, for example, a hard disk drive 512 and removable storage drive 514. Removable storage drive 514 may include a floppy disk drive, a magnetic tape drive, an optical disk drive, a flash memory, or the like. The removable storage drive 514 reads from and/or writes to a removable storage unit 518 in a well-known manner. Removable storage unit 518 may include a floppy disk, magnetic tape, optical disk, etc. which is read by and written to by removable storage drive 514. As will be appreciated by persons skilled in the relevant art, removable storage unit 518 includes a computer readable storage medium having stored thereon computer software and/or data.

Computer system 500 (optionally) includes a display interface 502 (which can include input and output devices such as keyboards, mice, etc.) that forwards graphics, text, and other data from communication infrastructure 506 (or from a frame buffer not shown) for display on display unit 530.

In alternative implementations, secondary memory 510 may include other similar means for allowing computer programs or other instructions to be loaded into computer system 500. Such means may include, for example, a removable storage unit 522 and an interface 520. Examples of such means may include a program cartridge and cartridge interface (such as that found in video game devices), a removable memory chip (such as an EPROM, or PROM) and associated socket, and other removable storage units 522 and interfaces 520 which allow software and data to be transferred from the removable storage unit 522 to computer system 500.

Computer system 500 may also include a communications interface 524. Communications interface 524 allows software and data to be transferred between computer system 500 and external devices. Communications interface 524 may include a modem, a network interface (such as an Ethernet card), a communications port, a PCMCIA slot and card, or the like. Software and data transferred via communications interface 524 may be in the form of signals, which may be electronic, electromagnetic, optical, or other signals capable of being received by communications interface 524. These signals may be provided to communications interface 524 via a communications path 526. Communications path 526 carries signals and may be implemented using wire or cable, fiber optics, a phone line, a cellular phone link, an RF link or other communications channels.

Some embodiments may be directed to computer products comprising software stored on any computer readable storage medium. Such software, when executed in one or more data processing devices, causes a data processing device(s) to operate as described herein.

Certain embodiments may be implemented in hardware, software, firmware, or a combination thereof. Some embodiments may be implemented via a set of programs running in parallel on multiple machines.

The summary and abstract sections may set forth one or more but not all exemplary embodiments of the present invention as contemplated by the inventor(s), and thus, are not intended to limit the present invention and the appended claims in any way.

Embodiments of the present invention have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments.

What is claimed is:

1. A system of alerting comprising:

an alert repeater, configured to:

receive an alert over a communication channel from an alert provider, and send the alert to an alert receiver over a browser update communication channel, wherein the browser update communication channel comprises a dedicated communication channel configured for providing updates to a web browser, and wherein the alert receiver has been installed in the web browser without any user interaction and the alert receiver is configured to display the alert in the web browser; and a geographical determiner configured to:

determine an effective geographical area for the alert, and limit the alert to the effective geographical area, wherein the alert is only sent to an alert receiver located in the effective geographical area.

2. The system of claim 1, wherein the geographical determiner is configured to determine an effective geographic area for the alert based upon IP geolocation.

3. The system of claim 1, wherein the geographical determiner is configured to determine an effective geographic area for the alert based upon a location entered by a user.

4. The system of claim 1, wherein the alert receiver is installed natively in the web browser.

5. The system of claim 1, wherein the alert comprises an information link to a website containing additional information about the alert.

6. The system of claim 1, wherein the alert provider is a governmental entity.

7. The system of claim 1, wherein the alert is a public safety alert.

8. The system of claim 1, wherein the alert comprises an expiration time, and the alert receiver is further configured to display the alert within the expiration time.

9. The system of claim 1, wherein the browser update communication channel uses a polling-based communication protocol.

10. The system of claim 1, wherein the browser update communication channel uses a push-based communication protocol.

11. The system of claim 1, wherein a service executing externally to the web browser comprises the alert receiver.

12. A method of receiving alerts in a web browser comprising:

receiving an alert in an alert receiver from an alert repeater, wherein:

the alert is received from the alert repeater over a browser update communication channel, wherein the browser update communication channel comprises a dedicated communication channel configured for providing updates to the web browser, the alert receiver is within an effective geographical area of the alert, and the alert receiver has been installed without any user interaction in the web browser; and displaying the alert in the web browser.

13. The method of claim 12, wherein the alert receiver is installed natively in the web browser.

14. The method of claim 12, wherein the alert is displayed in a status bar in the web browser.

15. The method of claim 12, wherein the alert comprises an information link to a website containing additional information about the alert.

16. The method of claim 12, wherein the alert is further comprises an expiration time, and the alert receiver is further configured to display the alert within the expiration time.

17. The method of claim 12, wherein receiving an alert in an alert receiver comprises:

receiving an alert via a service executing externally to the web browser.

18. The method of claim 12, further comprising:

restoring the web browser window if an alert is received by the alert receiver while the web browser window is minimized.

19. The method of claim 12, further comprising:

opening the web browser if an alert is received by the service while the web browser is closed.

20. A method of sending alerts in a web browser comprising:

receiving an alert in an alert repeater from an alert provider;

determining an effective geographical area for the alert; and sending the alert using a browser update communication channel to an alert receiver within the effective geographical area for the alert, wherein the browser update communication channel comprises a dedicated communication channel configured for providing updates to the web browser, and wherein the alert receiver has been installed without any user interaction in the web browser.

21. The method of claim 20, wherein determining an effective geographical area for the alert comprises:

determining an effective geographical area for the alert based upon IP geolocation.

22. The method of claim 20, wherein determining an effective geographical area for the alert comprises:

determining an effective geographical area for the alert based upon a location entered by a user.

23. The method of claim 20, wherein the alert provider is a governmental entity.

24. The method of claim 20, wherein the alert is a public safety alert.

25. The method of claim 20, wherein the browser update communication channel uses a polling-based communication protocol.

26. The method of claim 20, wherein the browser update communication channel uses a push-based communication protocol.

* * * * *